US011215330B1

(12) United States Patent
Ross et al.

(10) Patent No.: US 11,215,330 B1
(45) Date of Patent: Jan. 4, 2022

(54) POWER ROUTING FOR ILLUMINATION DEVICE

(71) Applicant: First-Light USA, LLC, Seymour, IL (US)

(72) Inventors: Jeremy B. Ross, Monticello, IL (US); Blake S. Good, Urbana, IL (US); Jacob A. Flagle, New Palestine, IN (US)

(73) Assignee: First-Light USA, LLC, Seymour, IL (US)

( * ) Notice: Subject to any disclaimer, the term of this patent is extended or adjusted under 35 U.S.C. 154(b) by 0 days.

(21) Appl. No.: 17/015,544

(22) Filed: Sep. 9, 2020

(51) Int. Cl.

| | |
|---|---|
| ***F21L 4/04*** | (2006.01) |
| ***F21V 17/12*** | (2006.01) |
| ***F21V 23/06*** | (2006.01) |
| ***F21V 33/00*** | (2006.01) |
| ***F21L 4/02*** | (2006.01) |

(52) U.S. Cl.
CPC ..... *F21L 4/045* (2013.01); *F21L 4/022* (2013.01); *F21V 17/12* (2013.01); *F21V 23/06* (2013.01); *F21V 33/0008* (2013.01)

(58) Field of Classification Search
CPC . F21L 4/022; F21L 4/025; F21L 4/027; F21L 4/04; F21L 4/045; F21V 21/145; F21V 21/30; F21V 14/025; F21V 19/02
See application file for complete search history.

(56) References Cited

U.S. PATENT DOCUMENTS 2,539,974 A * 1/1951 Riddell ..... F21L 4/045 362/199
5,083,246 A 1/1992 Lambert
5,183,324 A * 2/1993 Thomas ..... F21L 4/04 362/103
5,695,279 A * 12/1997 Sonnleitner ..... F21S 2/00 362/249.09
6,224,235 B1 5/2001 Parker
6,260,979 B1 * 7/2001 Lin ..... B25B 23/18 362/119
6,457,841 B1 * 10/2002 Lynch ..... F21L 4/045 362/197
6,604,837 B2 8/2003 Sandberg
6,619,813 B1 9/2003 Schnell
(Continued)

FOREIGN PATENT DOCUMENTS

CN 203656591 U 6/2014

OTHER PUBLICATIONS

International Search Report and Written Opinion dated Feb. 12, 2019, from the ISA/US, for International Application No. PCT/US18/52773 (filed Nov. 28, 2018), 10 pgs.
(Continued)

*Primary Examiner* — Alexander K Garlen
(74) *Attorney, Agent, or Firm* — Ascenda Law Group, PC

(57) ABSTRACT

An illumination device has a battery compartment with a pair of terminals electrically connected to one or more circuit elements housed in a pivotable illumination module through a pair of pivot joint elements. Each pivot joint element is disposed at a respective one of a pair of pivot joints about which the pivotable illumination module pivots. The battery compartment preferably includes a screwably-mounted cover having a securing lanyard attached to the illumination device at one of the pair of pivot joints.

17 Claims, 16 Drawing Sheets

(56) References Cited

U.S. PATENT DOCUMENTS

| | | | | |
|---|---|---|---|---|
| 6,913,370 | B2 * | 7/2005 | Ping | F21L 4/045 362/197 |
| 6,953,259 | B2 | 10/2005 | Parsons et al. | |
| 8,851,697 | B2 | 10/2014 | Quittner | |
| 9,366,419 | B2 | 6/2016 | Osborn | |
| 9,732,948 | B1 | 8/2017 | Malina et al. | |
| 10,030,847 | B2 * | 7/2018 | Worman | G02B 5/0215 |
| 10,072,829 | B1 * | 9/2018 | Christ | F21V 5/006 |
| 2005/0094385 | A1 * | 5/2005 | Lee | B60Q 3/44 362/98 |
| 2006/0262523 | A1 * | 11/2006 | Smith | F21V 21/06 362/157 |
| 2008/0049433 | A1 * | 2/2008 | Sharrah | H03K 17/968 362/362 |
| 2008/0174991 | A1 * | 7/2008 | Tucker | F21L 4/027 362/200 |
| 2009/0027876 | A1 * | 1/2009 | Yu | F21V 14/065 362/184 |
| 2010/0232147 | A1 * | 9/2010 | Bryant | F21V 23/0407 362/183 |
| 2011/0063826 | A1 * | 3/2011 | Lau | F21L 4/027 362/190 |
| 2011/0255286 | A1 * | 10/2011 | Christ | F21L 4/04 362/249.02 |
| 2014/0177203 | A1 * | 6/2014 | Novak | F21V 25/04 362/95 |
| 2017/0163942 | A1 | 6/2017 | Teetzel | |
| 2019/0093867 | A1 * | 3/2019 | Qiu | F21L 4/04 |
| 2019/0261604 | A1 * | 8/2019 | Solan | F21V 21/145 |

OTHER PUBLICATIONS

International Application No. PCT/US2018/062773 filed Nov. 28, 2018; International Preliminary Report on Patentability dated Mar. 4, 20202; IPEA/US; 15 pgs.

* cited by examiner

POWER ROUTING FOR ILLUMINATION DEVICE

STATEMENT REGARDING FEDERALLY SPONSORED RESEARCH OR DEVELOPMENT

This invention was made with government support under FA875119CA058 awarded by the Air Force Research Laboratory (DOD-USAF—AFMC). The government has certain rights in the invention.

FIELD OF THE INVENTION

The present invention relates generally to power routing within an illumination device and, in particular, to the use of pivot joint components as a means for transferring power from a battery to an illumination element within the illumination device.

BACKGROUND

Illumination devices find application in a variety of fields and activities. Such devices as are intended to be worn on the person of a user are often worn atop a wearer's head, e.g., secured by or to a strap, cradle, or helmet, etc., or positioned on or in spectacle frames, e.g., near the wearer's temples. The benefit of such head-worm illumination devices is that they leave the wearer's hands free to perform tasks other than holding the illumination device.

U.S. patent application Ser. No. 16/994,303, filed Aug. 14, 2020, U.S. patent application Ser. No. 16/910,468, filed Jun. 24, 2020, U.S. patent application Ser. No. 16/202,627, filed Nov. 28, 2018, now U.S. Pat. No. 10,731,835, and U.S. patent application Ser. No. 16/983,252, filed Aug. 3, 2020, each commonly assigned to the present assignee, and incorporated herein by reference, describe various illumination devices that include one or more battery-operated light sources disposed within a housing and operable by switches mounted on the housing.

SUMMARY OF THE INVENTION

In one embodiment, a frame include a mount and an illumination module. The illumination module is pivotably secured in the mount by a pair of pivot joint elements, which are made of a conductive material and are components of an electrical path from a power source contained within the mount to one or more electrical components housed with the illumination module. In various embodiments, the mount includes a battery compartment adapted to receive at least one battery, and which included a first terminal electrically connected to a first of the pivot joint elements and a second terminal electrically connected to a second of the pivot joint elements. The battery compartment may be closed at one end by a cover (which may be adapted to be screwably coupled to the battery compartment) that includes a spring element electrically connected via an inner portion of the cover to the first terminal of the battery compartment. The cover may be secured to the mount by a lanyard. The mount thus supports the illumination module in complementary, bilateral pivot joints in arms of the mount and the pivot joint elements pivotably secure the illumination module to the mount at the bilateral pivot joints.

The illumination module may include a plurality of light sources, each of which is independently operable via an associated one of a plurality of activation switches. For example, each light source may be independently operable in a plurality of operation modes via an associated one of the plurality of activation switches. Further, each light source may be disposed behind a protective cover.

With the battery compartment being closed at one end by a cover, the cover may include a spring element electrically connected via an inner portion of the cover to the first terminal of the battery compartment. As mentioned, the cover may be secured to the mount by a lanyard, with a first end of the lanyard rotatably mounted to an arm of the mount at a pivot joint adapted to receive the removable, pivotable module.

In further embodiments, an illumination device configured in accordance with the present invention may include a mount having a battery compartment adapted to receive at least one battery and having a cap end and a second end, and an illumination module pivotably attached to the frame by a pair of pins, the illumination module housing at least one illumination element, an activation switch for the at least one illumination element, and a control circuit for said at least one illumination element. An electrical path for providing power to the control circuit runs from a screwable cover adapted to be removably secured to the cap end of the battery compartment, through a first one of said pair of pins, to a first contact element of the control circuit housed within the illumination module, and from a second contact element of the control circuit, to a second one of the pair of pins, to a terminal at the second end of the battery compartment. The screwable cover may be affixed to the mount with a securing lanyard, a first end of which may be rotatably mounted to an arm of the mount at a pivot joint adapted to receive the removable, pivotable module.

In some embodiments, the first and second contact elements of the control circuit may be friction contacts and respective ones of the pair of pins are electrically coupled respective ones of the pair of friction contacts within the illumination module.

The screwable cover may include a spring terminal adapted to contact a first terminal of a battery within the battery compartment. Further, the terminal at the second end of the battery compartment is electrically insulated from the terminal at the cap end of the battery compartment which is electrically coupled to the spring terminal in the screwable cover.

In still further embodiments, an illumination device has a battery compartment with a pair of terminals electrically connected to one or more circuit elements housed in a pivotable illumination module through a pair of pivot joint elements, each disposed at a respective one of a pair of pivot joints about which the pivotable illumination module pivots. The battery compartment preferably includes a screwably-mounted cover having a securing lanyard attached to the illumination device at one of the pair of pivot joints.

These and further embodiments of the present invention are discussed in more detail below.

BRIEF DESCRIPTION OF THE DRAWINGS

The present invention is illustrated by way of example, and not limitation, in the figures of the accompanying drawings, in which.

DESCRIPTION

Figure 1:
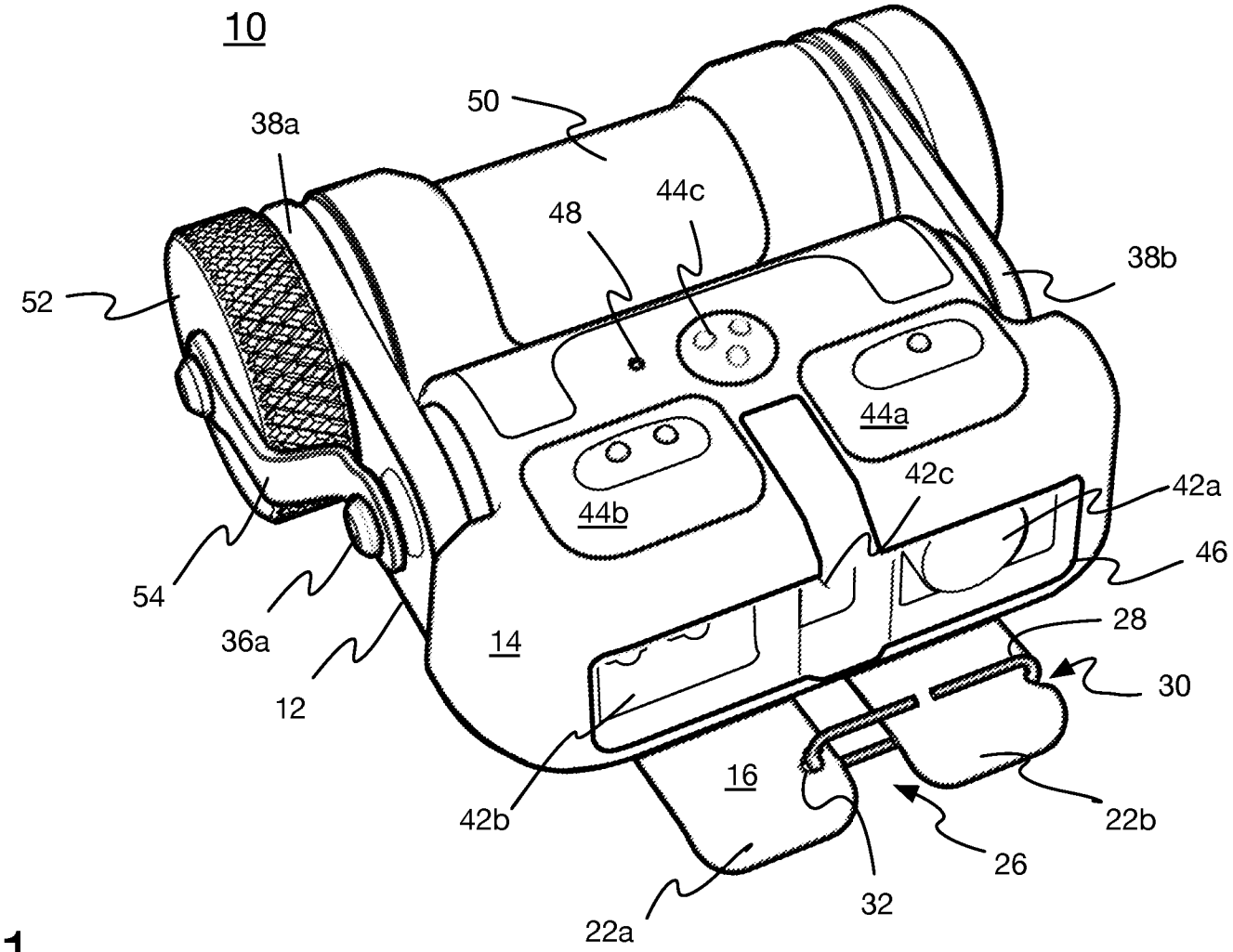
FIG. 1 illustrates a front perspective view of an illumination device that includes a mount for receiving and supplying power to a pivotable module in accordance with embodiments of the present invention.
Figure 2:
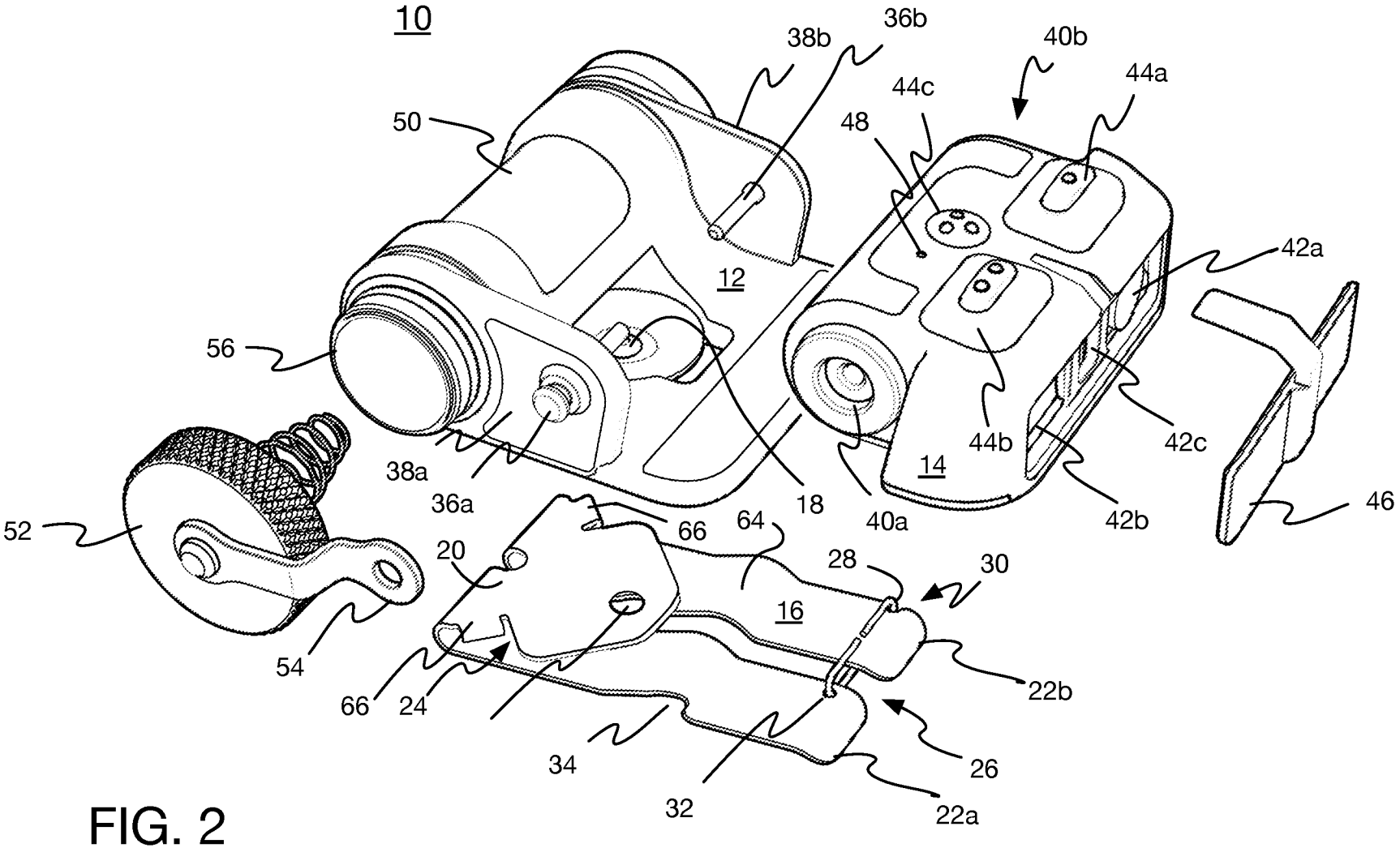
FIG. 2 is an exploded view of the illumination device illustrated in FIG. 1, showing the pivotable module as well as other components.
Figure 3:
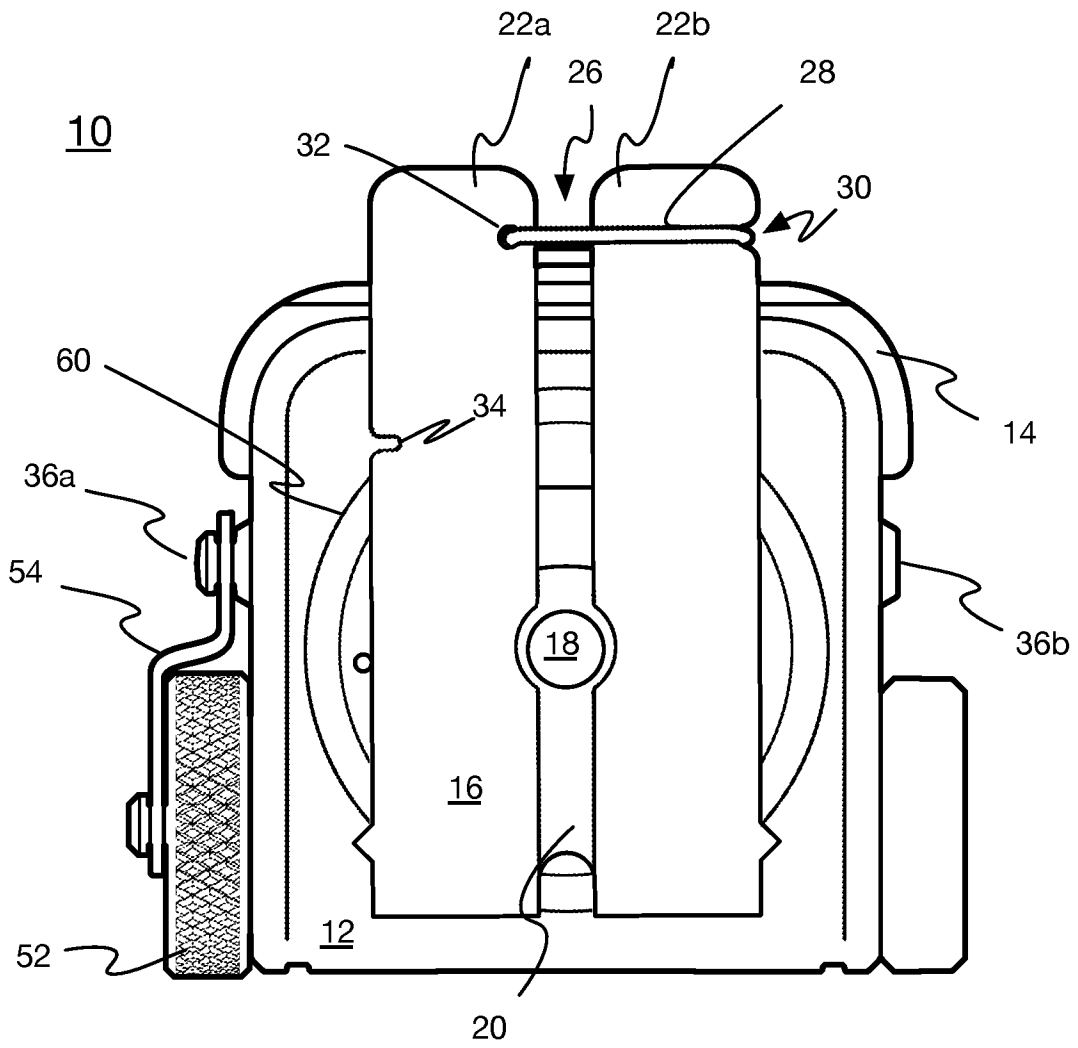
FIGS. 3, 11, 12, and 13 are bottom views of the illumination device illustrated in FIG. 1.
Figure 4:
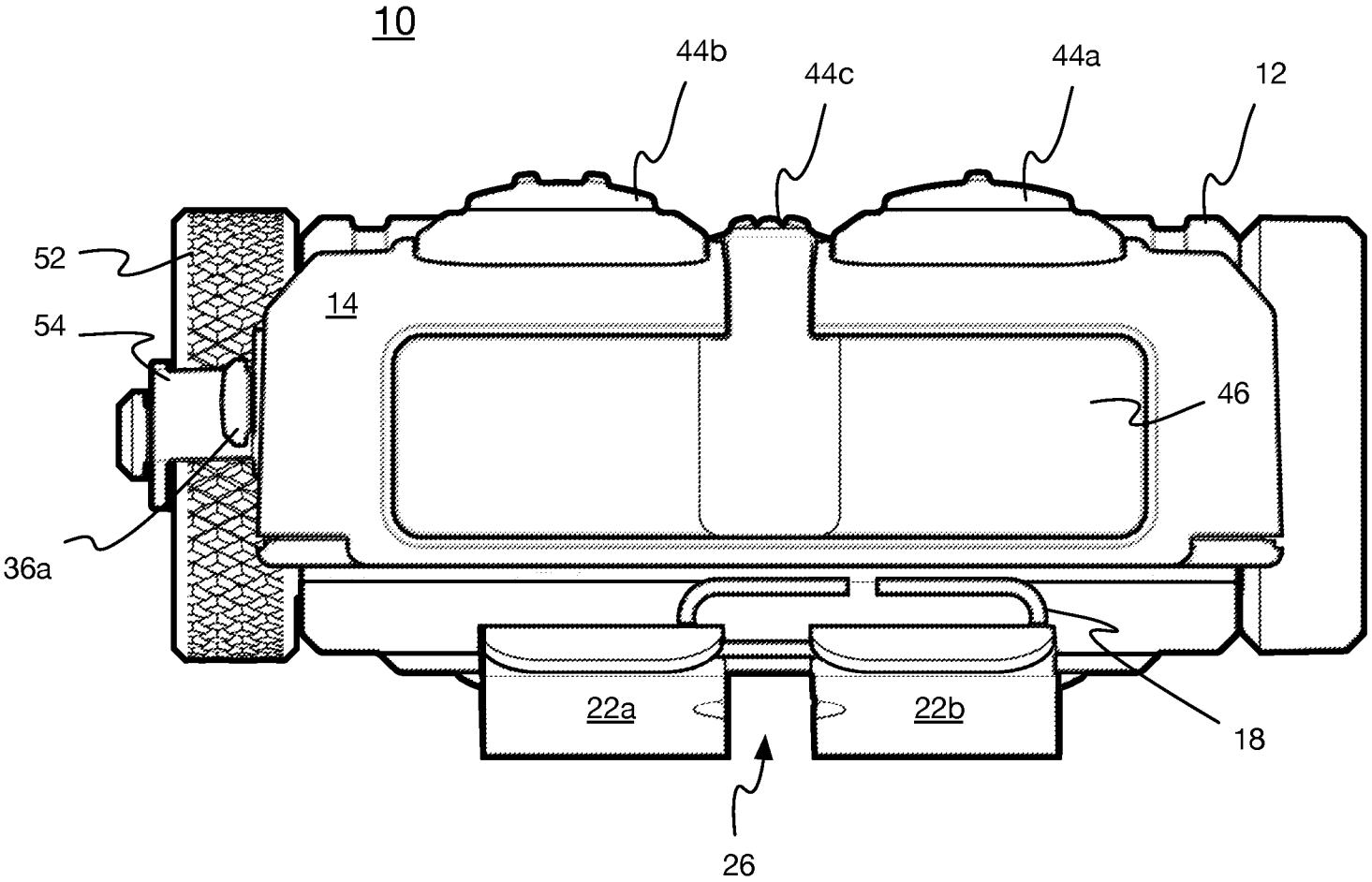
FIG. 4 is a front view of the illumination device illustrated in FIG. 1.
Figure 5:
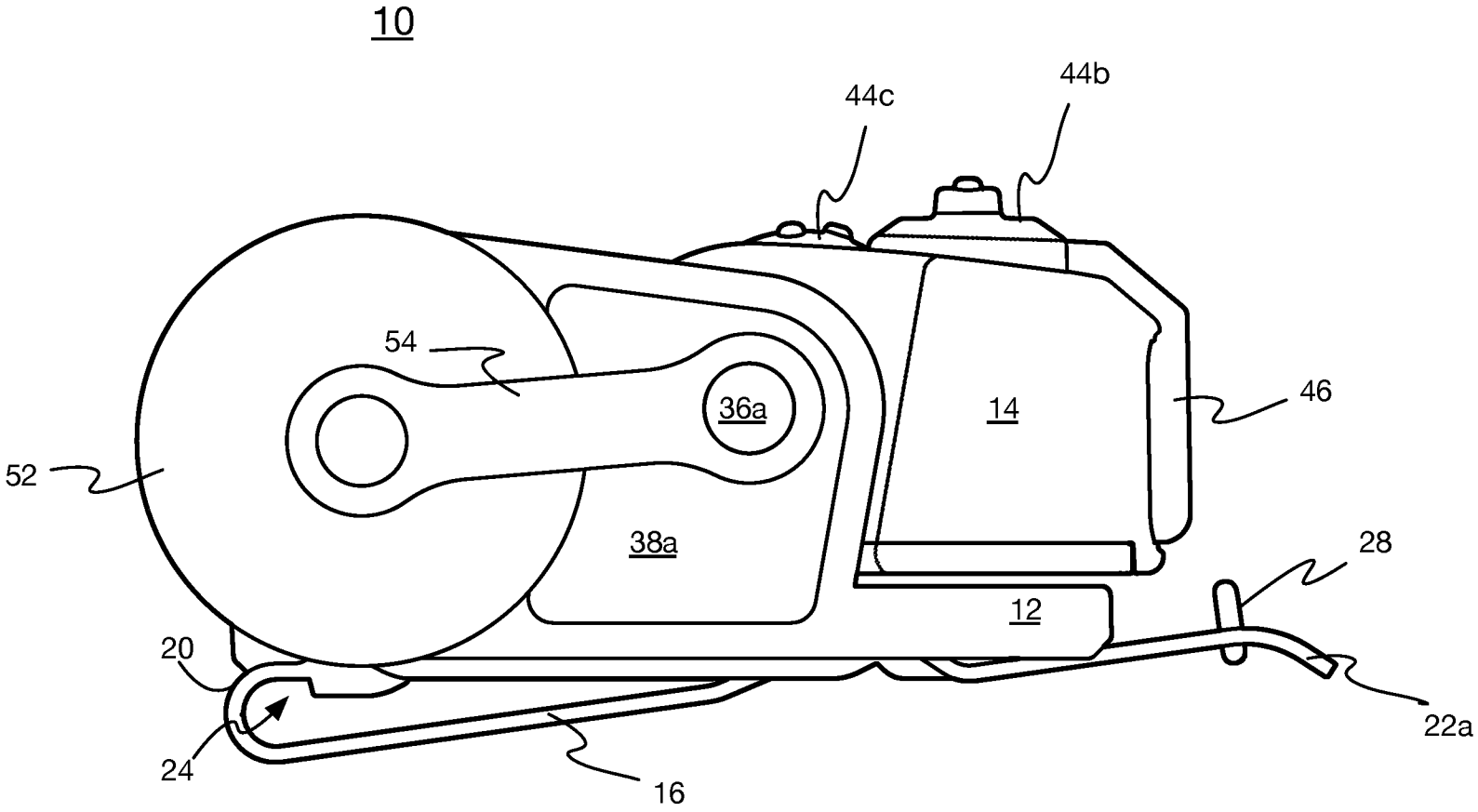
FIG. 5 is a right-side view of the illumination device illustrated in FIG. 1.
Figure 6:
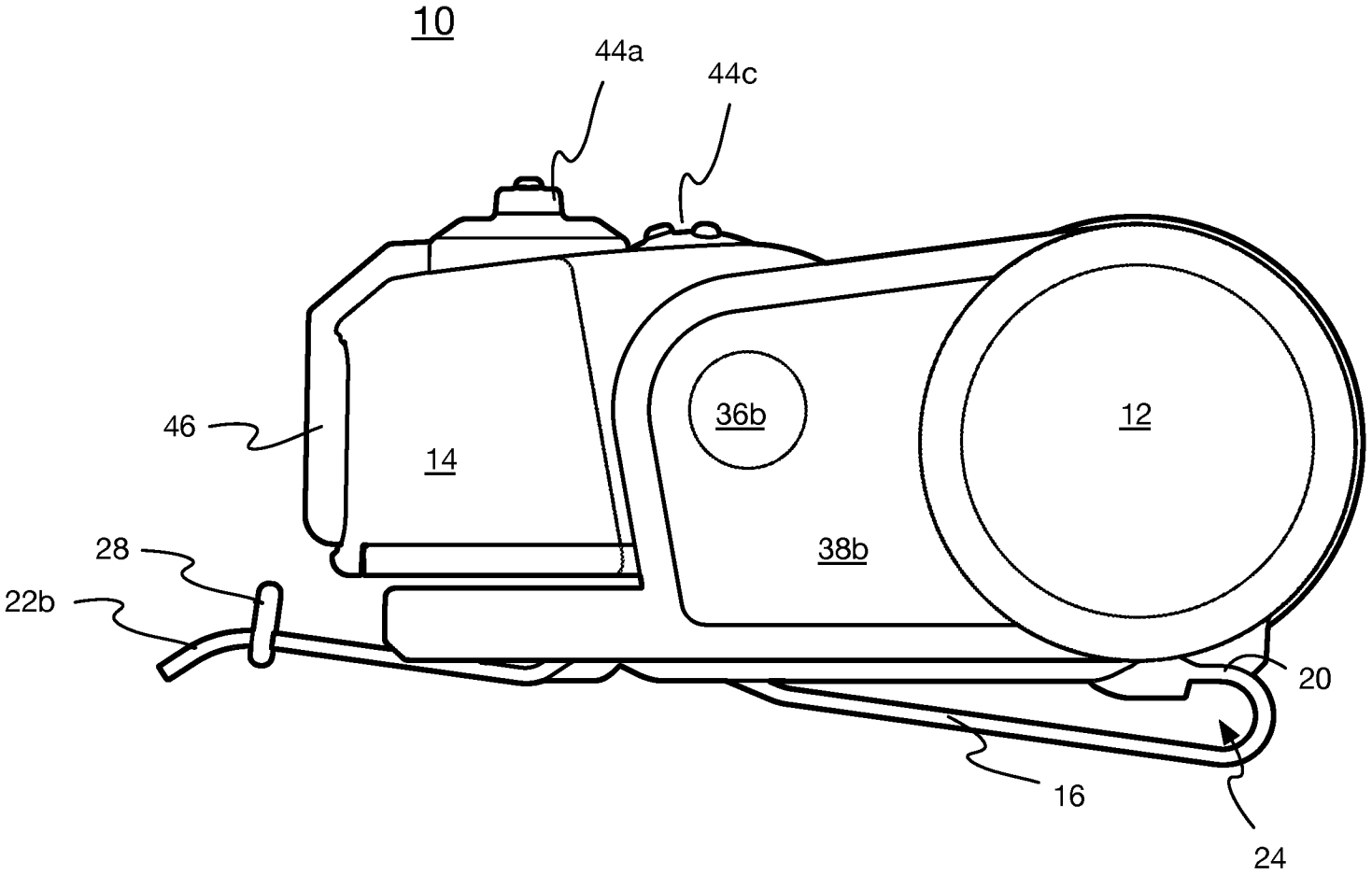
FIG. 6 is a left-side view of the illumination device illustrated in FIG. 1.
Figure 7:
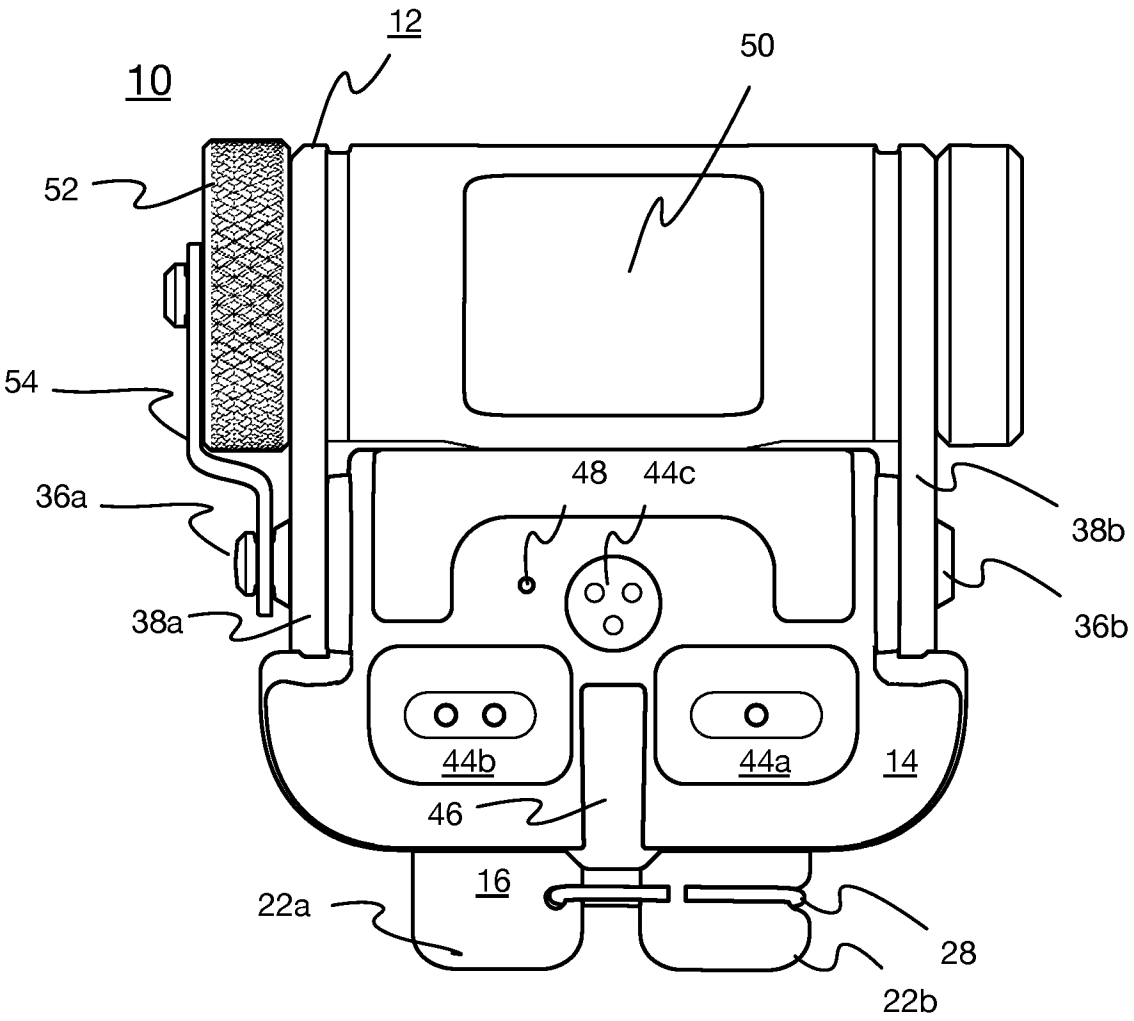
FIG. 7 is a top view of the illumination device illustrated in FIG. 1.
Figure 8:
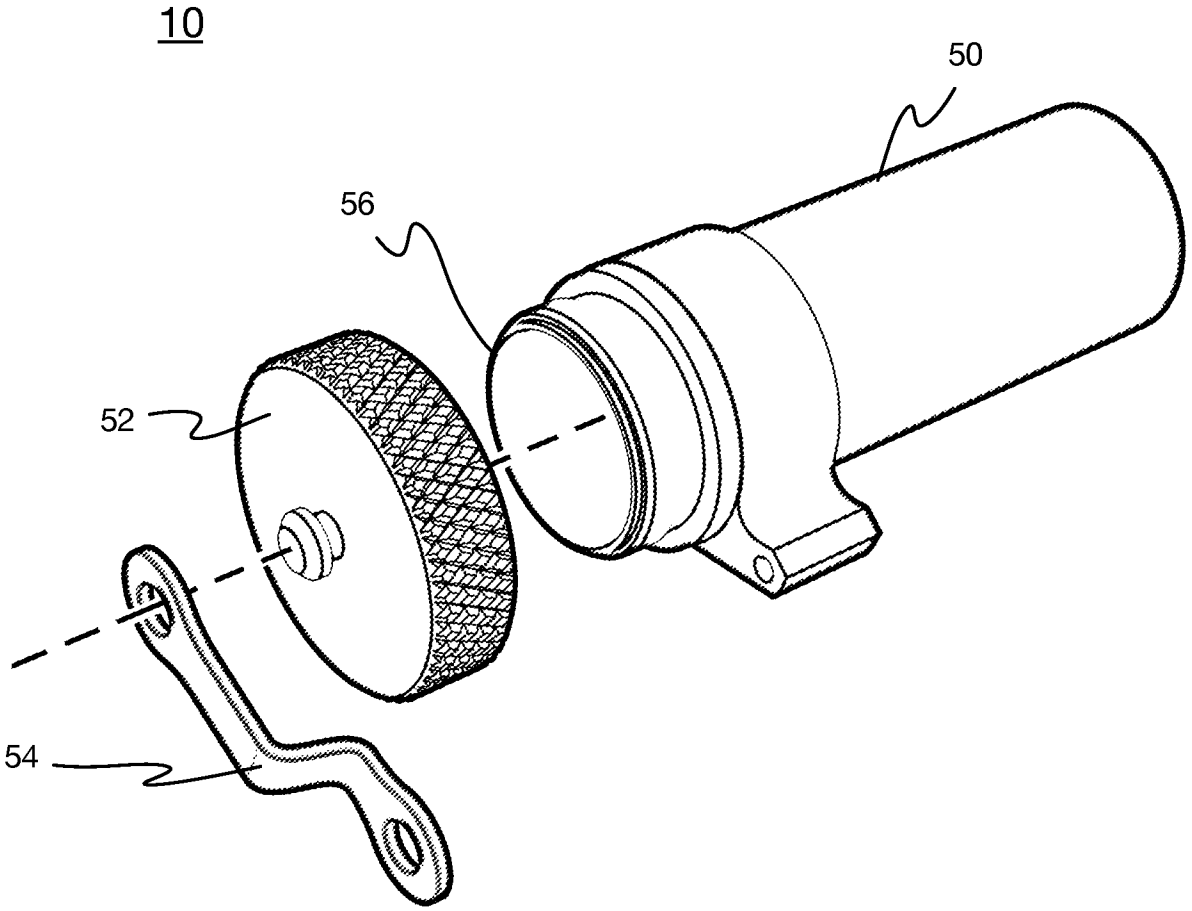
FIG. 8 illustrates aspects of the battery compartment for the illumination device illustrated in FIG. 1.
Figure 9:
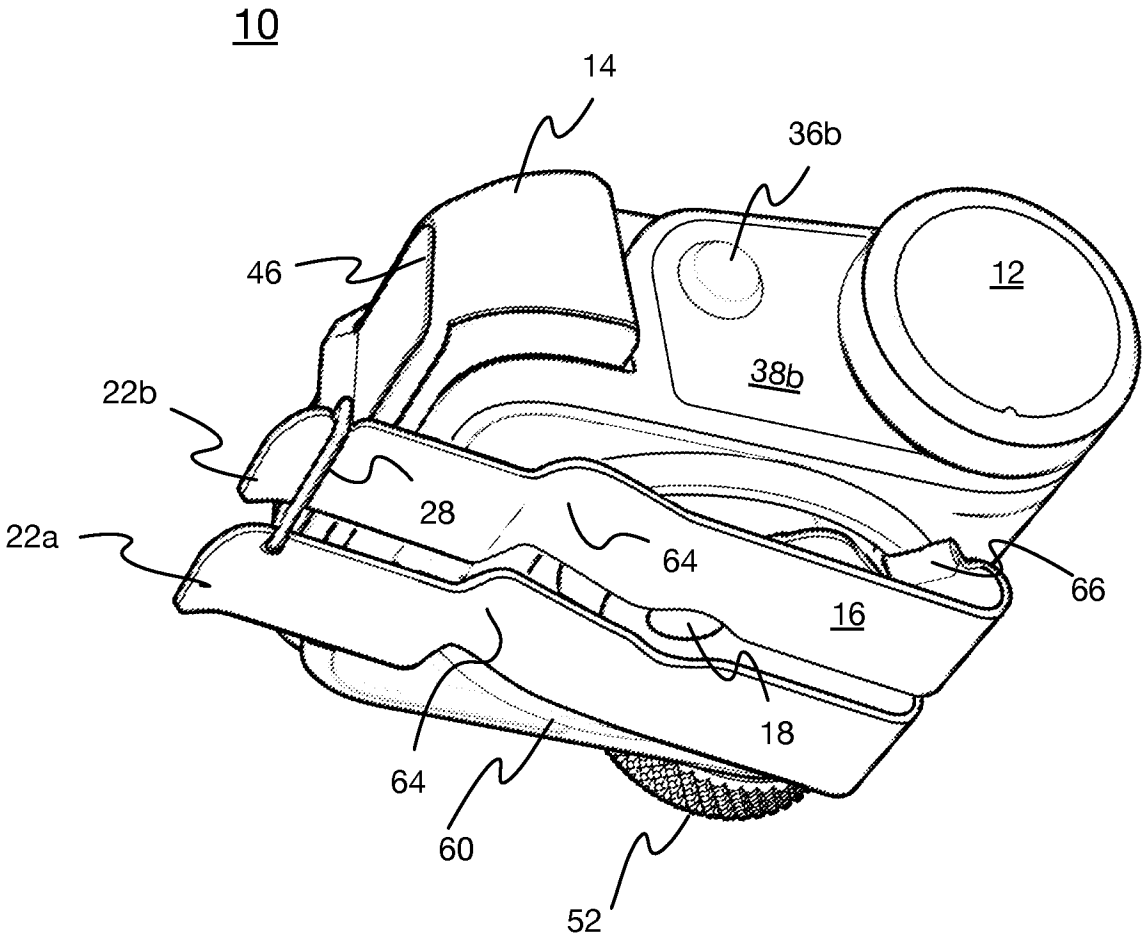
FIGS. 9 and 10 are bottom perspective views of the illumination device illustrated in FIG. 1.

Described herein are examples of power routing within an illumination device and, in particular, the use of pivot joint components as a means for transferring power from a battery to an illumination element within the illumination device. In the following description, an example of an illumination device having a pivotable module that houses one or more light sources is provided. However, this is only for sake of convenience and explanation and the illumination device is merely one example of a broader category of devices configured to accommodate various kinds of modules, for example illumination modules, communication modules, audio/video player/recording modules, guidance modules, translator modules, etc., in complementary, bilateral pivot joints in arms of a mount. Thus, reference to an illumination device, illumination module, and/or illumination element should be understood as being merely for convenience and not as a limitation of the present invention. To highlight this broader category of devices, the present description employs the term "frame."

Referring now to FIGS. 1-15 in which like components are designated with like reference numbers, an example of a frame 10 configured in accordance with embodiments of the present invention is shown. Frame 10 includes a mount 12 for receiving and supplying power to a removable, pivotable module 14. A clip 16 is rotably attached to the mount 12, e.g., by a pin 18, and is rotatable through an arc of up to 360 degrees in a plane defined by a connection between the clip and the mount. In the illustrated example, pin 18 secures a base portion 20 of the clip 16 to the frame 12 and the clip 16 is rotatable in a plane about an axis defined by (in this example orthogonal to) pin 18.

The clip 16 has a base portion 20 and a pair of elongated members 22*a*, 22*b*, where the elongated members are folded underneath the base portion, thereby defining a gap 24 between the base portion 20 and the elongated members 22*a*, 22*b* folded thereunder, which gap is configured to receive portions of a webbing or other article (e.g., a strap, a bill of a cap, a collar, cuff, or front placket of a shirt, an edge of a table, pedestal, or other surface, a bracket on a wall, ceiling, cockpit, or other surface, a belt, suspenders, or other article of clothing, or generally any convenient item which is stationary relative to the frame and of a size that can be accommodated in gap 24). The elongated members 22*a*, 22*b* are separated from one another by a longitudinal opening 26 (at least along a portion of their length) for accommodating sewing ribs between the portions of the webbing or other article, and a gate 28 is securably engaged to a first one of the elongated members 22*a*, 22*b* and is rotatable between an open position (see, e.g., FIG. 13) in which the gate does not obstruct the longitudinal opening 26 and a closed position (see, e.g., FIGS. 1-7, 9, 10, and 12) in which the gate obstructs the longitudinal opening.

In the illustrations, the gate 28 is a locking wire. When in its closed position, the locking wire, which is secured to elongated member 22*a* by passing through a hole 32 therein, removably engages elongated member 22*b* to obstruct the longitudinal opening 26, for example by removably engaging elongated member 22*b* at a recess 30 in a longitudinal outside edge of elongated member 22*b*. When in its open position, the locking wire 28 removably engages elongated member 22*a* at a recess 34 in a longitudinal outside edge of elongated member 22*a*. Thus, in addition to one of the elongated members securing at least one end of the locking wire, each respective one of the elongated members 22*a*, 22*b* may include a recess in a respective longitudinal outside edge thereof for removably engaging the locking wire. In other embodiments of the invention, the gate 28 may be a member that swings closed and open (e.g., about a pin securing it to one of the elongated members of the clip), obstructing the longitudinal opening 26 when in its closed position and not obstructing the longitudinal opening 26 when in its open position, or a cap that can be fitted cover the two ends of the elongated members 22*a*, 22*b* and obstruct the longitudinal opening 26 when it is in place. The cap may be securably attached to the clip 16 (or not) when it is not in use. Alternatively, the gate 28 may be a barrel bolt latch or a chain latch which obstructs the longitudinal opening 26 when in its closed position and does not obstruct the longitudinal opening 26 when in its open position.

As mentioned above the mount 12 is configured to receive and supply power to a removable, pivotable module 14. In the illustrated examples, module 14 is an illumination module and it is received in complementary, bilateral pivot joints in arms 38*a*, 38*b* of the mount 12. For example, and referring to FIG. 15 in particular, the pivot joints may include pins 36*a*, 36*b* that mate with sockets 40*a*, 40*b* in module 14. Pin 36*a* may be disposed beneath a cover 70 when the device is assembled and the battery compartment cover 52 is secured to the mount 12 by lanyard 54.

While the illustrated example of module 14 is an illumination module, in other embodiments different kinds of modules may be supported, e.g., communication modules, audio/video player/recording modules, guidance modules, translator modules, etc. Returning to FIGS. 1-15, the illustrated illumination module 14 includes a plurality of light sources 42*a*, 42*b*, 42*c*, each one independently operable via an associated one of a plurality of activation switches 44*a*, 44*b*, 44*c*. Each light source may be independently operable in a plurality of operation modes via an associated one of the activation switches. And, each light source may be disposed behind a protective cover 46 (e.g., a removable plastic cover/diffuser).

In one embodiment, light source 42*a* is one or more light emitting diodes (LEDs) that produce(s) white light and is activated by activation switch 44*a*. A single press and release of activation switch 44*a* turns the associated light source 42*a* on or off, and while light source 42*a* is on, depressing and holding activation switch 44*a* adjusts the brightness of light source 42*a*. In one embodiment, light source 42*b* is one or more LEDs that produce light at a wavelength compatible with night vision imaging systems and is(are) activated by activation switch 44*b*. A single press and release of activation switch 44*b* turns the associated light source 42*b* on or off, and while light source 42*b* is on, depressing and holding activation switch 44*b* adjusts the brightness of light source 42*b*. In one embodiment, light source 42*c* is one or more LEDs that produce(s) light at an infra-red wavelength and is(are) activated by activation switch 44*b*. A single press and release of activation switch 44*c* turns the associated light source 42*c* on or off. While light source 42*c* is on, depressing and holding activation switch 44*c* adjusts the brightness of light source 42*c*. While light source 42*c* is off, depressing and holding activation switch 44*c* activates light source 42*c* as an infra-red light beacon (e.g., for signaling others without being visible to humans). An indicator light 48 on top of the illumination module 14 indicates when the light source 42*c* is on. If light source 42*c* is on and either of activation switch 44*a* or 44*b* is depressed, light source 42*c* will be turned off. Pressing and holding both of activation switches 44*a* and 44*b* at the same time will lock or unlock, as appropriate, the illumination module 14. In the locked mode, none of the light sources will be activated by their associated activation switches. Only when the illumination module 14 is placed in its unlocked mode (by pressing and holding both of activation switches 44*a* and 44*b* at the same time) will the light sources be available to be activated by operation of their associated activation switches. As illustrated, the various illumination switches 44*a*, 44*b*, 44*c* may have different numbers of molded protuberances on their upper surfaces so that they can be readily distinguished from one another by an operator in the dark and/or without having to look at the device.

The frame 10 preferably includes a battery compartment 50 with a screwably-mounted cover 52. The screwably-mounted cover 52 may be affixed to the mount 12 with a securing lanyard 54, and in one embodiment a first end of the securing lanyard 54 by which the screwably-mounted cover 52 is affixed to the mount 12 is rotatably mounted to an arm 38*a* of the mount 12 at one of the pivot joints adapted to receive the removable, pivotable module 14, e.g., via pin 36*a*. The screwably-mounted cover 52 is adapted to engage a threaded sleeve 56 of the battery compartment 50. In other embodiments, the cover of the battery compartment may engage the battery compartment via a bayonet fitting or other fitting.

Figure 10:
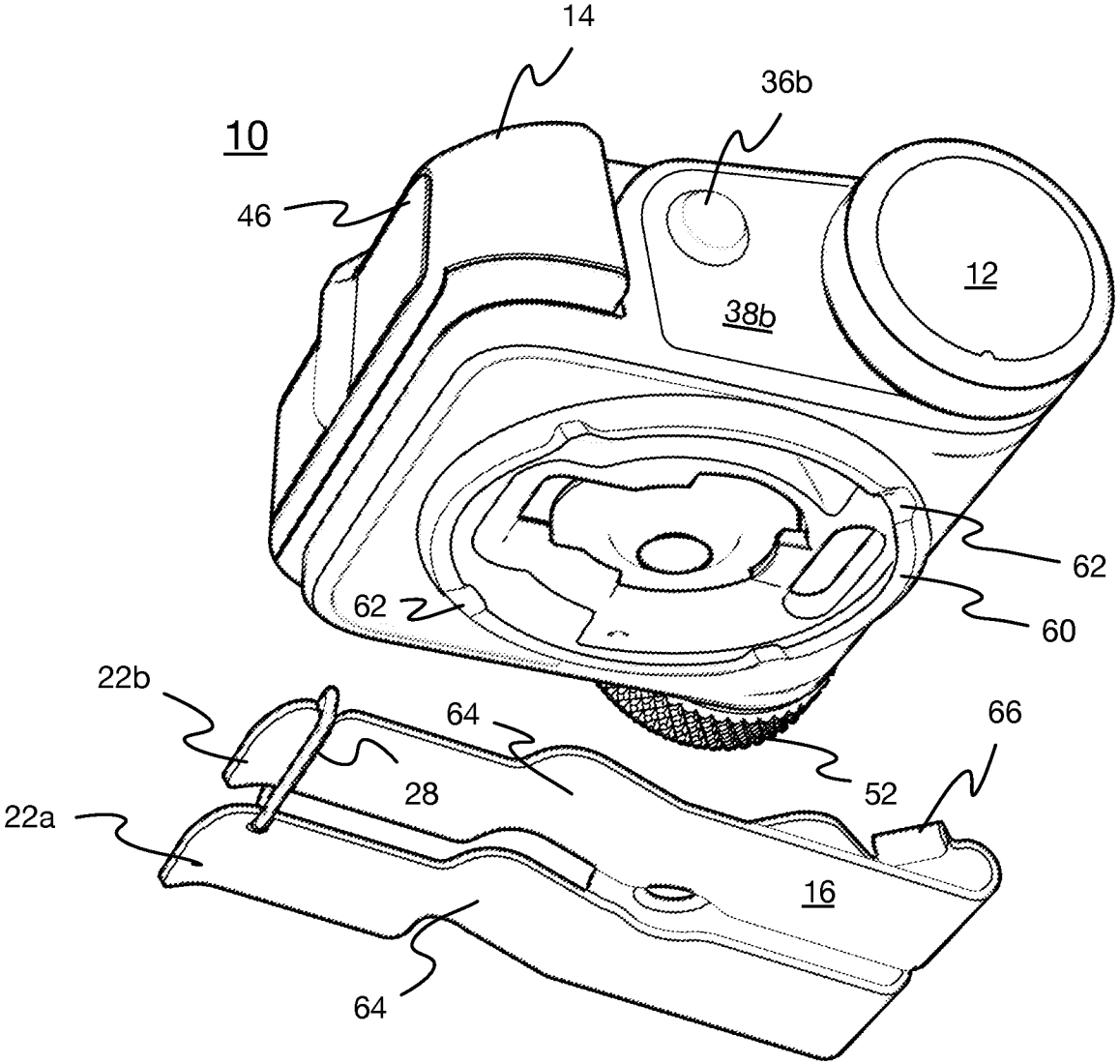
Figure 11:
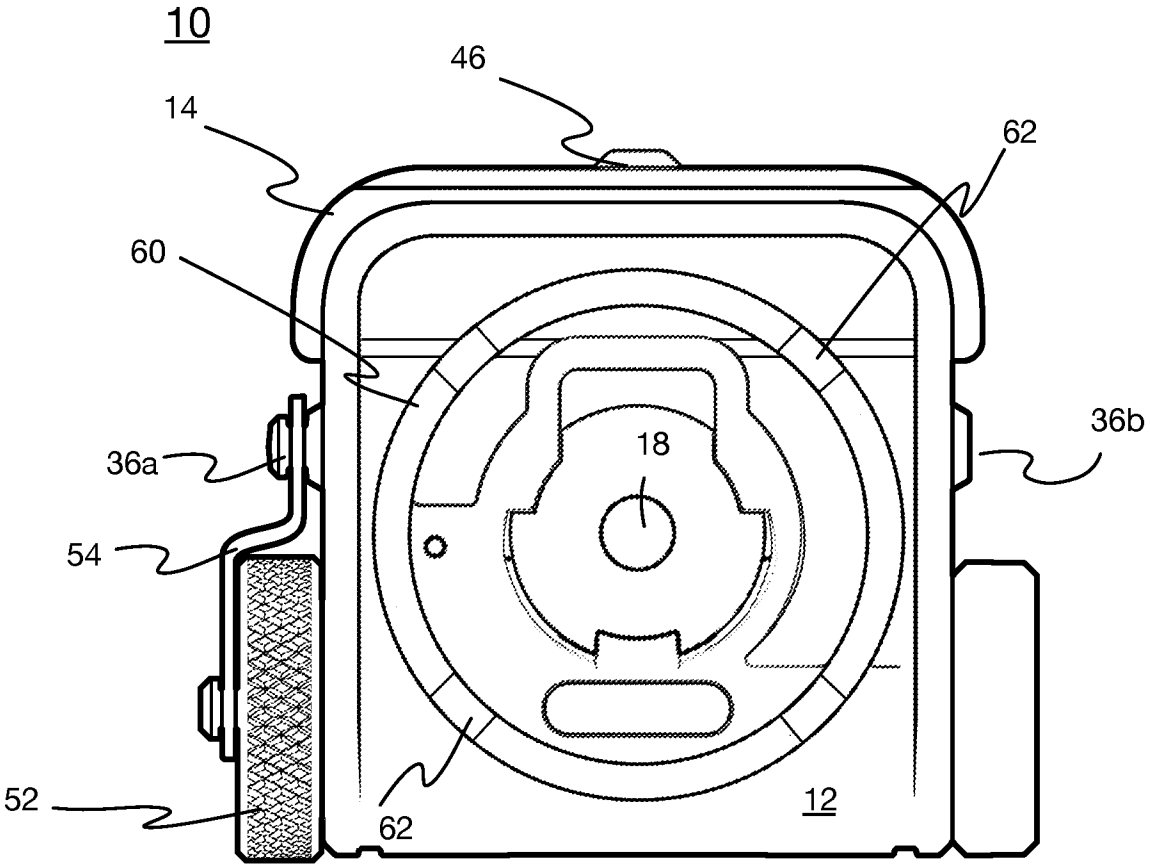
Figure 12:
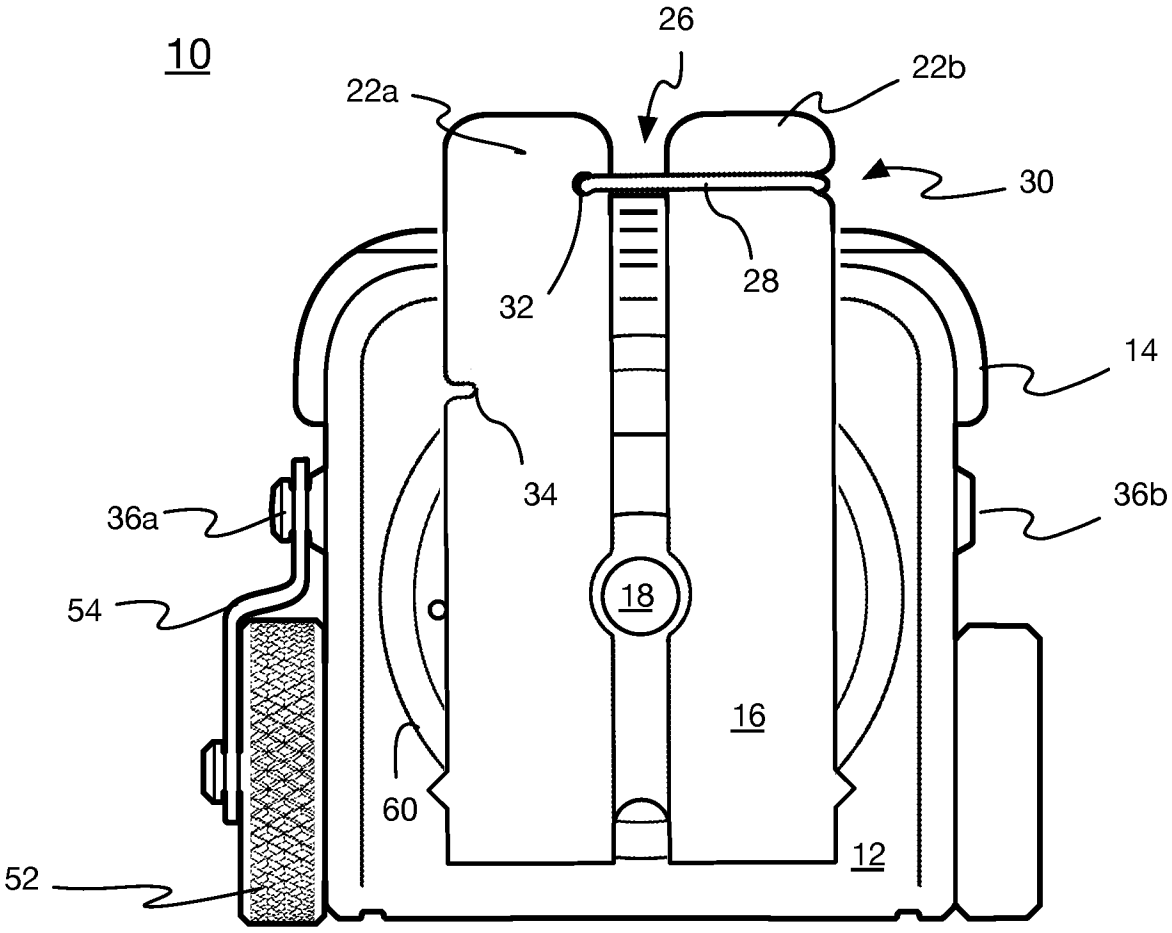
Figure 13:
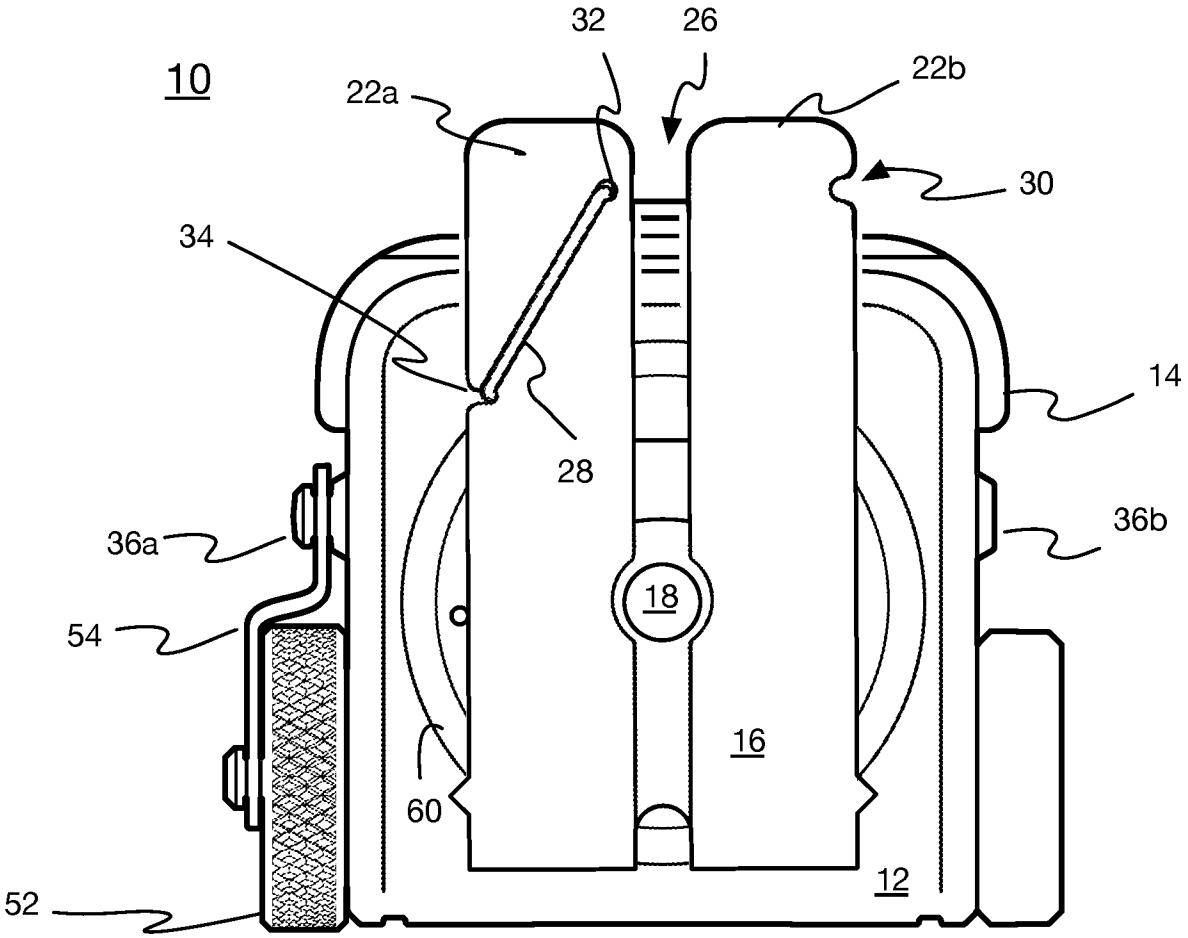
Figure 14:
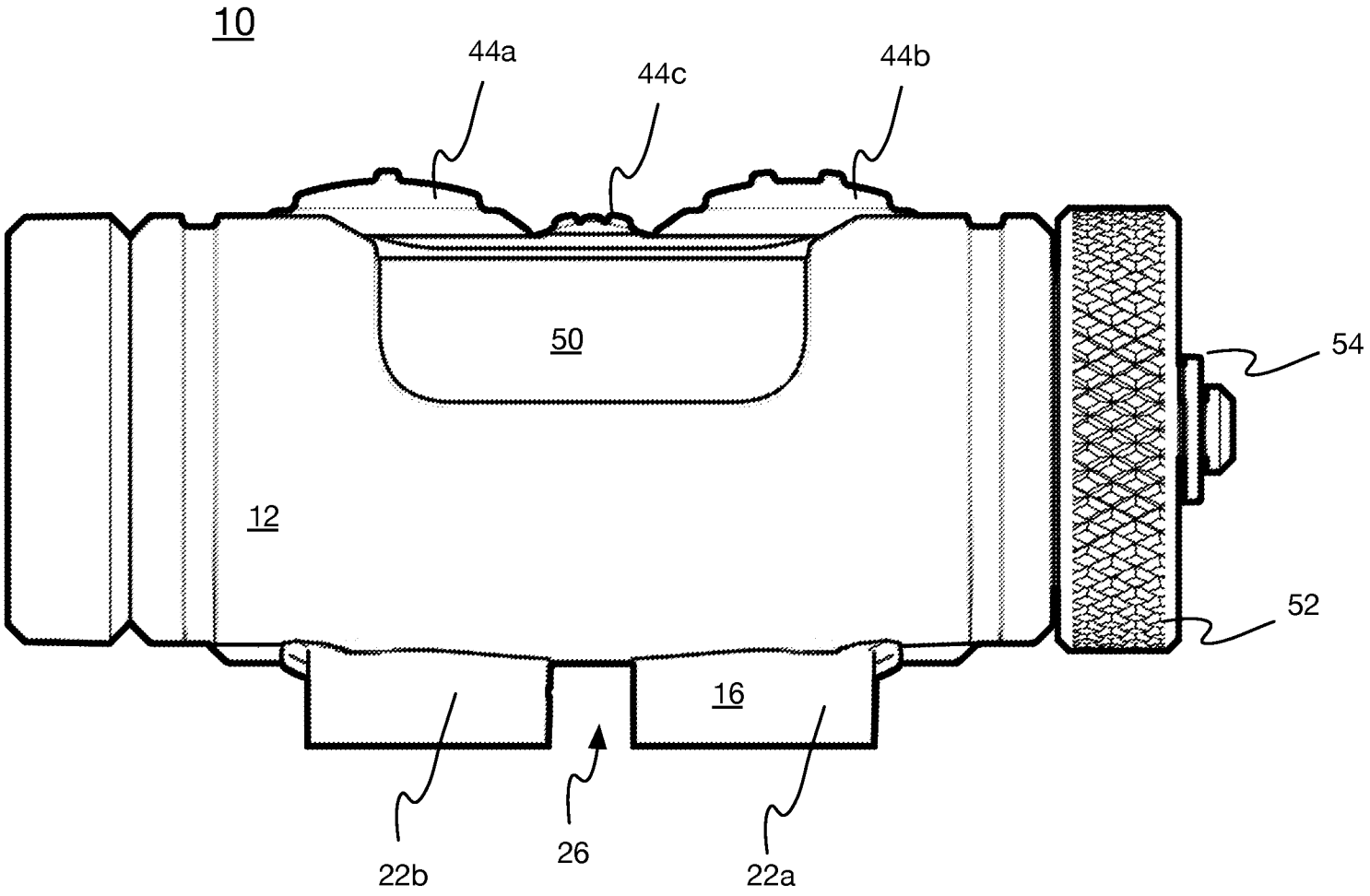
FIG. 14 is a back view of the frame illustrated in FIG. 1.

As indicated above, the clip 16 may be rotably attached to the mount 12 by a pin 18, and, referring in particular to FIGS. 10 and 11, the mount 12 may include a rim 60 over which the clip 16 rotates. Such a rim 60 may include a plurality of detents 62 sized to accommodate one or more complementary projections 64, 66 of the clip 16 as it rotates through an arc of 360 degrees over the rim 60. For example, in one embodiment the rim 60 of the mount 12 over which the clip 16 rotates includes four detents 62 spaced 90 degrees from one another around the rim and the detents are sized to accommodate complementary projections 64, 66 of the clip 16 as it rotates over the rim through the 360 degree arc.

From the above it should be apparent that one embodiment of the invention provides an illumination device having a frame 10 with an illumination module 14 pivotably mounted within the frame and a clip 16 rotably attached to the frame and rotatable through an arc of up to 360 degrees in a plane defined by a connection between the clip and the frame. The clip 16 has a pair of elongated members 22*a*, 22*b* folded beneath its base portion 20, thereby defining a gap 24 configured to receive portions of a webbing or other article. The elongated members 22*a*, 22*b* are separated from one another by a longitudinal opening 26 for accommodating sewing ribs between the portions of the webbing or other article, and a gate 28 (e.g. a locking wire) securably engaged to a first one of the elongated members 22*a* and rotatable between an open position in which the gate 28 does not obstruct the longitudinal opening 26 and a closed position in which the gate 28 obstructs the longitudinal opening 26. For those instances where the gate is a locking wire, when in the closed position, the locking wire may be secured to a first one of the elongated members 22*a* and removably engage a second one of the elongated members 22*b*, for example by removably engaging the second one of the elongated members at a recess 30 in a longitudinal outside edge of the second one of the elongated members. When in the open position, the locking wire may removably engage the first one of the elongated members 22*a* at a recess 34 in a longitudinal outside edge of the first one of the elongated members. Thus, each respective one of the elongated members 22*a*, 22*b* may include a recess 30, 34 in a longitudinal outside edge of the respective elongated member for removably engaging the locking wire.

The illumination module 14 may include one or more light sources 42*a*, 42*b*, 42*c*, for example a primary light source 42*a*, which may be an incandescent lamp but is preferably an LED, and one or more secondary light sources 42*b*, 42*c*, which likewise may be incandescent lamps but are preferably LEDs, arranged on either side of the primary light source. The secondary light sources are optional, and when present may be arranged in patterns on either side of the primary light source. In the illustrated embodiment, the secondary light sources 42*b*, 42*c*, are arranged on a single side of the primary light source 42*a* in linear alignment therewith along a horizontal axis of a light source array, but this is merely one example of a possible arrangement thereof. In some cases, the secondary light sources may be arranged in circular, arrow, or grid patterns on either or different sides of the primary light source. That is, some secondary light sources on one side of the primary light source may be arranged differently than other secondary light sources on the opposite side of the primary light source. Further, secondary light sources in addition to or in lieu of ones placed to the sides of the primary light source may be positioned above and/or below the primary light source.

The primary light source 42*a* and, when present, one or more of the secondary light sources 42*b*, 42*c*, preferably emit light in the visible light spectrum. Often, the primary light source will emit white light, but this is not necessarily so and instead the primary light source may emit light at other or additional wavelengths. Alternatively, the primary light source may emit white light, but an optional filter may be positioned thereover so as to allow only specific wavelengths to pass. Such a filter may be supported by a lip around the front of the light source.

One or more of the secondary light sources 42*b*, 42*c* may emit light in the ultra violet or infra-red spectrums. Such secondary light sources are useful, for example, when the illumination device is employed as a signaling mechanism and the wearer does not wish to divulge his/her position by emitting visible light which may be seen by others with the naked eye. It is contemplated that the primary light source may also emit light in the ultra violet or infra-red spectrums, but most often will be a source of white light or colored light. In some instances, the primary light source may be a dual- or multi-source LED with one emitter for white light and one or more separate emitters for non-white light, including but not limited to light outside of the visible spectrum.

At the front of light source array is a face plate or diffuser 46, which may include baffles for the various light sources. In some instances, the face plate may support irises for one or more of the light sources to allow control over the amount of light emitted. Also, the face plate may include a lens mount for the primary light source to allow for the placement of one or more lenses, filters, or covers.

At the rear of the frame is a screwably-mounted battery cover 52 and battery compartment 50. The illumination device is adapted to be powered by one or more alkaline, lithium ion, metal hydride, or other batteries. In one embodiment, a single 1.5V AAA-size or AA-size alkaline battery may be used, but the use of replaceable batteries of other sizes or configurations is also contemplated. For example, 3.6V disposable lithium ion batteries in size AA or AAA and/or 3.7 V rechargeable lithium ion batteries in size AA or AAA may be used. Batteries may be placed in/removed from the illumination device by unscrewing the battery cover 52, removing a used battery (if present) from the associated compartment 50, replacing it with a new or recharged battery, and then replacing the battery cover. While a screw fitting for the battery cover is preferred, other mounting arrangements, such as a bayonet fitting or a snap-top fitting may be used. All of the electronic circuitry for the illumination device is included within the confines of the illumination module 14 (which preferably is watertight) and power from the battery is provided via contact points on the pins 36*a*, 36*b* at the pivot joints on the mount 12.

Figure 15:
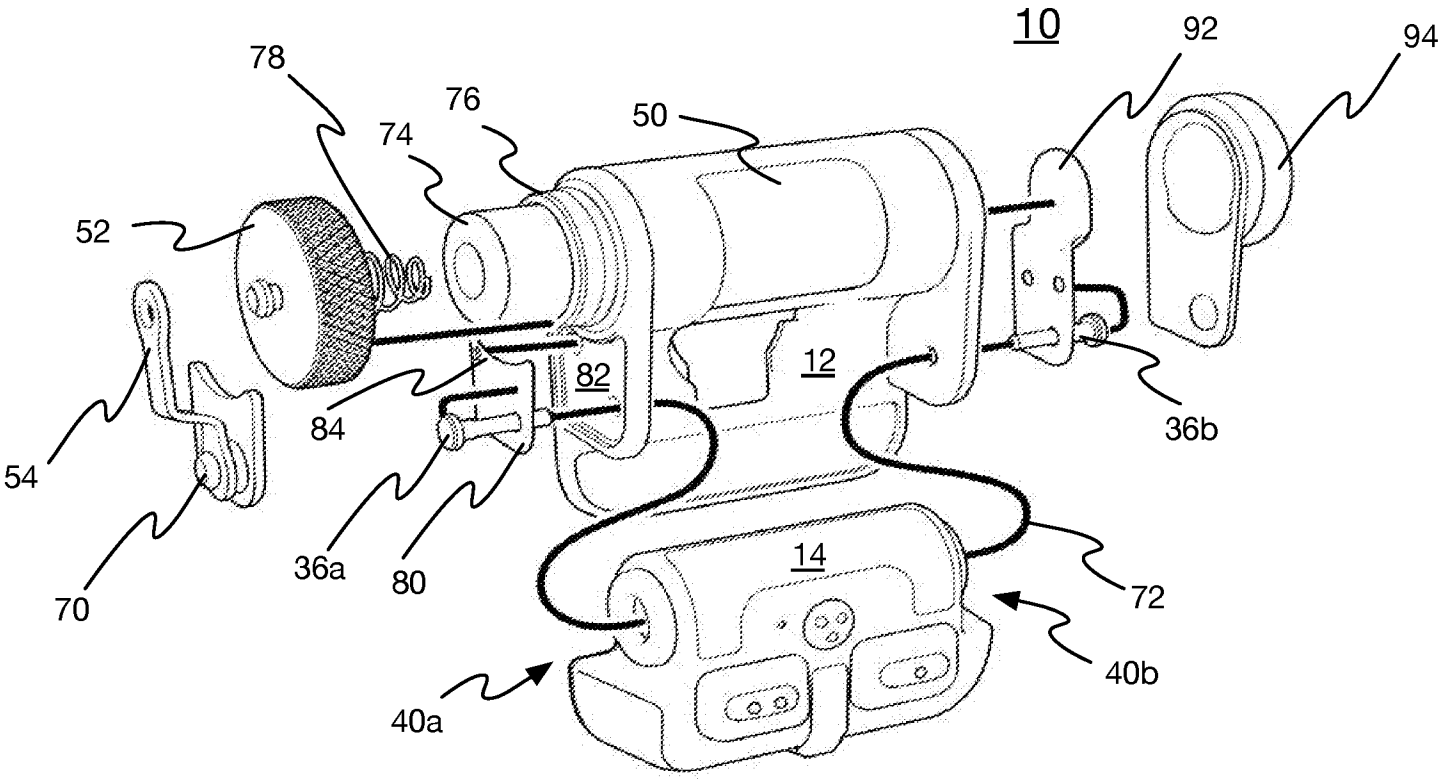
FIG. 15 highlights power routing within the illumination device illustrated in FIG. 1 in accordance with embodiments of the present invention.

FIG. 15 illustrates an example of this power routing. In this illustration, the heavy black line segments 72 show the power routing path. In this example, power is provided to the pivotable illumination module 14 from a battery 74 in the battery compartment 50 via twin pivot elements, namely pins 36*a*, 36*b*. That is, the twin pivot elements not only provide the means by which the pivotable illumination module is pivotably attached to the mount 12, but also are themselves conductors and the means by which power is, in part, provided to the illumination module and its circuitry. The use of the pivot elements as conductors avoids the need for separate power routing elements such as wires.

As shown in this illustration, the battery compartment 50 includes an inner sleeve 76, which is preferably made of a metal such as aluminum. Battery 74 is received in the battery compartment, that is, in inner sleeve 76, which is shaped and sized so as to accommodate one or more batteries such as those described above. At a cap end of battery compartment 50, battery compartment cover 52, which includes a spring terminal 78, is screwably mounted such that an inner portion of the cover 52 contacts the inner sleeve 76 of battery compartment 50. Spring terminal 78 is electrically coupled to the inner portion of cover 52. Spring terminal 78 and the inner portion of the cover 52 are also made of a metal, such as aluminum; accordingly, when the cover 52 is screwably attached at the cap end of battery compartment 50, an electrical path exists between one terminal of battery 74 through the spring terminal 78 and the inner portion of the cover 52 to the inner sleeve 76 of battery compartment 50.

Also shown in the illustration is plate 80, which is shaped and sized to be contained within a recess 82 of mount 12. Plate 80 is preferably made of a metal, such as aluminum, and has a contact portion 84 which extends so as to be electrically coupled to the inner sleeve 76 of battery compartment 50 when the device is assembled. This extends the electrical path discussed above to plate 80, and pin 36*a*, which is also made of a metal such as aluminum, contacts the plate 80 when inserted therethrough and into the socket 40*a* of module 14. Thus, pin 36*a* is not only the means by which the illumination module 14 is pivotably attached to the mount 12, but is also a conductor and part of the means by which power is provided to the illumination module and its circuitry.

Figure 16:
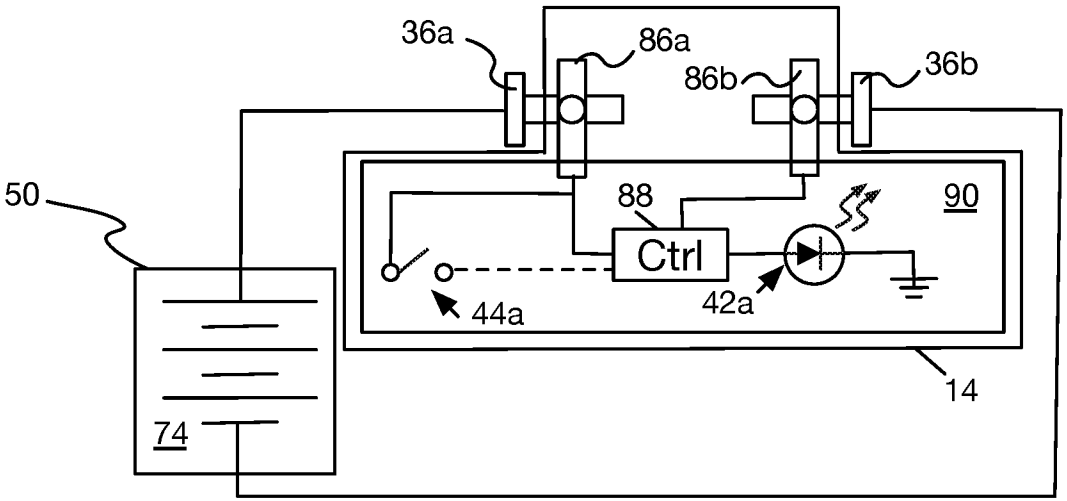
FIG. 16 is a schematic view of power routing within the illumination device illustrated in FIG. 1 in accordance with embodiments of the present invention.

Referring also now to FIG. 16, within illumination module 14 is a circuit board 90 having a pair of friction contacts 86*a*, 86*b*. When pins 36*a*, 36*b* are inserted to form the pivot joints for module 14, each makes contact with a respective one of the friction contacts 86*a*, 86*b*. The friction contacts 86*a*, 86*b* are each configured to maintain electrical contact with their respective pin 36*a*, 36*b* as module 14 is pivoted about the pivot joints. For example, each friction contact may be configured to receive its respective pin in a spring-like coupling between two metal flanges. Alternatively, each friction contact may be configured as a hollow metal cylinder having a diameter sized to receive a male portion of its respective pin. Other friction contacts may also be used. Preferably, the tolerances of the friction contacts and pins are such as to provide wipe when the pins are inserted into the pivot joints so as to maintain minimal electrical resistance at the electrical contact therebetween.

As shown in the illustration, the electrical path from pin 36*a* is via the friction contact 86*a* to a controller 88 on circuit board 90 in module 14. Controller 88 is electrically coupled to receive control inputs from the activation switches 44*a*, 44*b*, 44*c* and to provide outputs to the light sources 42*a*, 42*b*, 42*c* in response thereto. For simplicity, only one such connection involving switch 44*a* and light source 42*a* is shown in the illustration. Responsive to an input via activation switch 44*a*, controller 88 illuminates light source 42*a* in an associated mode.

The electrical path from controller 88 and module 14 is to pin 36*b*, that is, to the pin at the opposite pivot joint for module 14, via an associated friction coupling 86*b*. As shown in FIG. 15, pin 36*b* is in electrical contact with a terminal at an end of battery compartment 50 opposite the cover 52. This terminal is preferably made of metal, e.g., aluminum, and is insulated from the inner sleeve 76 of the battery compartment so that it only makes electrical contact with a terminal of the battery 74. Terminal 92 is covered by a rubber gasket 94 to provide a watertight seal for the battery when included in the battery compartment. Thus, the electrical path for providing power to module 14 and the circuitry and illumination or other electrical/electronic elements housed therein runs from a battery compartment cover adapted to be removably secured to a cap end of the battery compartment through a first one of a pair of pivot joint elements to a first contact element of a control circuit housed within an illumination module and from a second contact element of the control circuit to a second one of the pair of pivot joint elements to a terminal at the second end of the battery compartment.

Returning to FIGS. 1-14, clip 16 is molded in the shape of an elongated "U", with a gap 24 between its base portion 20 and the elongated members 22*a*, 22*b* to receive a webbing, strap, bill of a cap, or other attachment means. While the clip 16 is preferably made of metal or other durable material, the mount 12 and modules 14 of the kind described herein may be fashioned from a variety of materials, including but not limited to plastics (e.g., zylonite), metals and/or metal alloys, cellulose acetates (including but not limited to nylon), carbon fiber, epoxy resins, and combinations of the foregoing. Fabrication processes for the mount, clip, and other components include, but are not limited to, injection molding, sintering, milling, and die cutting. Alternatively, or in addition, one or more additive manufacturing processes, such as extrusion, vat photopolymerization, powder bed fusion, material jetting, or direct energy jetting, may be used to fashion the illumination device and/or components thereof.

Illumination devices configured in accordance with embodiments of the present invention provide a relatively small (in terms of area being occupied), augmentative, illumination source that does not interfere with eye protection, loupes, masks, etc. when worn by a user. In addition to lighting, the present frame provides a platform for image and/or video capture and/or projection devices. For example, rather than or in addition to light sources, one or more cameras may be included in a module supported by the frame. Further, one or more microphones may be provided in place of or in addition to the light sources. Hands-free operation of the light sources, camera(s), and/or microphone (s) may be facilitated using voice activation.

As discussed above, the clip 16 may be swivelly attached to the mount 12. This allows the entire clip to be rotated with respect to the mount through an arc of up to 360 degrees in a plane defined by the connection between the clip and the mount. In the illustrated example, pin 18 secures the mount 12 to the clip 16 and the clip rotates in a plane orthogonal to and about the axis of pin 18. In general, any of a variety of swivel joints may be used for such a connection. For example, the clip may be fitted to the mount with a cylindrical post or pin, which post may turn freely or in a ratchet fashion, with respect to a receiving support structure in or on mount 12. A ratchet joint would allow the azimuthal direction of the clip with respect to the mount to be set without fear that it will easily deviate therefrom. The same may be accomplished using a snuggly fitting friction joint, for example as provided by overlapping, hollow cylindrical posts associated with the clip and mount that are prevented from coming apart by flanges on their ends. The rotating attachment of the clip and mount is optional but advantageous in certain applications of the device.

Devices configured in accordance with embodiments of the present invention are suitable for application in a variety of contexts, including military, law enforcement, consumer recreational, and others. Devices configured in accordance with embodiments of the present invention can be worn with or without a helmet, hat, or other headdress, and can also be attached to straps worn on a user's head, hand, or elsewhere, and can also be attached to nylon or other strap-like webbing. Such devices may also be secured to any convenient protruding edge of furniture or other articles.

Thus, power routing within an illumination device, in particular the use of pivot joint components as a means for transferring power from a battery to an illumination element within an illumination device, has been described.

What is claimed is:

1. A frame, comprising a mount and an illumination module pivotably secured in said mount by a pair of bilateral pivot joint pins which mate with sockets in the illumination module and about which the illumination module is rotatable, the pivot joint pins being made of a conductive material and being components of an electrical path from a power source contained within said mount to one or more electrical components housed with said illumination module; wherein said mount includes a battery compartment adapted to receive at least one battery, the battery compartment including a first terminal electrically connected to a first of the pivot joint pins and a second terminal electrically connected to a second of the pivot joint pins.

2. The frame of claim 1, wherein the battery compartment is closed at one end by a cover, the cover including a spring element electrically connected via an inner portion of the cover to the first terminal of the battery compartment.

3. The frame of claim 2, wherein the cover is secured to the mount by a lanyard.

4. The frame of claim 2, wherein the cover is adapted to be screwably coupled to the battery compartment.

5. The frame of claim 4, wherein the cover is secured to the mount by a lanyard.

6. The frame of claim 1, wherein bilateral pivot pins are positioned in arms of the mount.

7. The frame of claim 1, wherein the illumination module includes a plurality of light sources, each light source independently operable via an associated one of a plurality of activation switches.

8. The frame of claim 2, wherein the illumination module includes a plurality of light sources, each light source independently operable via an associated one of a plurality of activation switches.

9. The frame of claim 8, wherein each light source is independently operable in a plurality of operation modes via an associated one of the plurality of activation switches.

10. The frame of claim 8, wherein each light source is disposed behind a protective cover.

11. The frame of claim 1, wherein the battery compartment is closed at one end by a cover, the cover including a spring element electrically connected via an inner portion of the cover to the first terminal of the battery compartment, the cover is secured to the mount by a lanyard, and a first end of the lanyard is rotatably mounted to an arm of the mount at a pivot joint adapted to receive the illumination module.

12. An illumination device, comprising:

a mount having a battery compartment adapted to receive at least one battery and having a cap end and a second end;

an illumination module pivotably attached to the mount by a pair of pins, the illumination module housing at least one illumination element, an activation switch for the at least one illumination element, and a control circuit for said at least one illumination element;

wherein an electrical path for providing power to said control circuit runs from a screwable cover adapted to be removably secured to the cap end of the battery compartment, through a first one of said pair of pins, to a first contact element of the control circuit housed within the illumination module, and from a second contact element of the control circuit, to a second one of the pair of pins, to a terminal at the second end of the battery compartment.

13. The illumination device of claim 12, wherein the screwable cover is affixed to the mount with a securing lanyard.

14. The illumination device of claim 13, wherein a first end of the securing lanyard by which the screwable cover is affixed to the mount is rotatably mounted to an arm of the mount at a pivot joint adapted to receive the illumination module.

15. The illumination device of claim 12, wherein the first and second contact elements of the control circuit are friction contacts and respective ones of the pair of pins are electrically coupled to respective ones of the pair of friction contacts within the illumination module.

16. The illumination device of claim 12, wherein the screwable cover includes a spring terminal adapted to contact a first terminal of a battery within the battery compartment.

17. The illumination device of claim 16, wherein the terminal at the second end of the battery compartment is electrically insulated from a terminal at the cap end of the battery compartment which is electrically coupled to the spring terminal in the screwable cover.

* * * * *